US008297411B2

(12) United States Patent
Hashimoto et al.

(10) Patent No.: US 8,297,411 B2
(45) Date of Patent: Oct. 30, 2012

(54) BRAKE DEVICE FOR USE IN AN ELEVATOR USING A TARGET PATTERN WHEN A HOIST IS NOT DRIVEN

(75) Inventors: Jun Hashimoto, Tokyo (JP); Takaharu Ueda, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 532 days.

(21) Appl. No.: 12/593,087

(22) PCT Filed: Mar. 27, 2007

(86) PCT No.: PCT/JP2007/056348

§ 371 (c)(1),
(2), (4) Date: Sep. 25, 2009

(87) PCT Pub. No.: WO2008/117423

PCT Pub. Date: Oct. 2, 2008

(65) Prior Publication Data

US 2010/0101897 A1 Apr. 29, 2010

(51) Int. Cl.
*B66B 1/32* (2006.01)

(52) U.S. Cl. ..... 187/288; 187/295; 187/290

(58) Field of Classification Search ..... 187/287, 187/288, 290, 293–297, 391–393; 318/779, 318/781, 375, 376, 782, 799–815; 307/64, 307/66

See application file for complete search history.

(56) References Cited

U.S. PATENT DOCUMENTS

| | | | | |
|---|---|---|---|---|
| 3,961,688 | A * | 6/1976 | Maynard | 187/289 |
| 4,662,478 | A * | 5/1987 | Uchino | 187/290 |
| 4,982,815 | A * | 1/1991 | Arabori et al. | 187/288 |
| 6,269,910 | B1 * | 8/2001 | Fargo et al. | 187/287 |
| 6,315,081 | B1 * | 11/2001 | Yeo | 187/290 |
| 6,971,482 | B2 * | 12/2005 | Takeda | 187/313 |
| 7,434,664 | B2 * | 10/2008 | Helstrom | 187/314 |
| 7,549,515 | B2 * | 6/2009 | Tegtmeier et al. | 187/288 |
| 7,690,483 | B2 * | 4/2010 | Tegtmeier et al. | 187/394 |
| 2010/0006378 | A1 * | 1/2010 | Blasko | 187/290 |
| 2010/0044160 | A1 * | 2/2010 | Agirman et al. | 187/290 |
| 2010/0170751 | A1 * | 7/2010 | Hashimoto et al. | 187/288 |
| 2011/0011681 | A1 * | 1/2011 | Kondo et al. | 187/247 |
| 2011/0120810 | A1 * | 5/2011 | Schroeder-Brumloop et al. | 187/290 |

FOREIGN PATENT DOCUMENTS

CN 1902116 A 1/2007

(Continued)

OTHER PUBLICATIONS

U.S. Appl. No. 12/812,609, filed Jul. 13, 2010, Ueda.

(Continued)

*Primary Examiner* — Anthony Salata
(74) *Attorney, Agent, or Firm* — Oblon, Spivak, McClelland, Maier & Neustadt, L.L.P.

(57) ABSTRACT

In an elevator device, movement of a car is braked by a brake device in a state in which driving of a hoist is stopped. While the drive of the hoist is stopped, braking force of the brake device is controlled by a brake control device based on a signal from a movement detector that generates a signal corresponding to movement of the car. The brake control device generates a target pattern for at least one of speed and acceleration of the car and controls braking force of the brake device such that the movement of the car follows the target pattern.

6 Claims, 7 Drawing Sheets

FOREIGN PATENT DOCUMENTS

| | | | | |
|---|---|---|---|---|
| JP | 50-54056 | | | 5/1975 |
| JP | 62 222989 | | | 9/1987 |
| JP | 04365770 | A | * | 12/1992 |
| JP | 05246641 | A | * | 9/1993 |
| JP | 06032552 | A | * | 2/1994 |
| JP | 8 40658 | | | 2/1996 |
| JP | 2004 231355 | | | 8/2004 |
| JP | 2005 247512 | | | 9/2005 |
| JP | 2006 160441 | | | 6/2006 |

OTHER PUBLICATIONS

U.S. Appl. No. 12/532,414, filed Sep. 22, 2009, Ueda, et al.
Chinese Office Action issued Sep. 21, 2011, in Patent Application No. 200780052325.2.
Japanese Office Action mailed on Feb. 7, 2012, issued for JP Application No. 2009-506136 (with English translation).
U.S. Appl. No. 12/664,670, filed Dec. 15, 2009, Hashimoto, et al.

* cited by examiner

BRAKE DEVICE FOR USE IN AN ELEVATOR USING A TARGET PATTERN WHEN A HOIST IS NOT DRIVEN

TECHNICAL FIELD

The present invention relates to an elevator apparatus including a brake device that brakes movement of a car and a balance weight.

BACKGROUND ART

Conventionally, there is proposed a rescue operation device at failure of an elevator that releases, when the elevator fails, a brake for stationarily holding a car and moves the car with a weight difference between the car and a balance weight. The brake is subjected to braking operation every time the car moves by a specified distance (see Patent Document 1).

Patent Document 1: JP 2005-247512 A

DISCLOSURE OF THE INVENTION

Problem to be solved by the Invention

However, in the conventional rescue operation device at failure of the elevator, the generation and release of braking force of the brake are abrupt, with the result that the car repeats quick acceleration and quick deceleration. Large load is applied not only to passengers in the car but also to a main rope that suspends the brake and the car.

The present invention has been made to solve the problem described above, and it is therefore an object of the present invention to provide an elevator apparatus that can stably move a car at abnormal time of an elevator.

Means for solving the Problem

An elevator apparatus according to the present invention includes: a car and a balance weight suspended by a main rope; a hoist that generates driving force for moving the car and the balance weight; a movement detector that generates a signal corresponding to the movement of the car; a brake device that brakes the movement of the car in a state in which driving of the hoist is stopped; and a brake control device that generates a target pattern concerning at least one of speed and acceleration of the car in a state in which the driving of the hoist is stopped and that controls braking force of the brake device based on the signal from the movement detector such that the movement of the car follows the target pattern.

BEST MODES FOR CARRYING OUT THE INVENTION

Best modes for carrying out the present invention are described below with reference to the drawings.

First Embodiment

Figure 1:
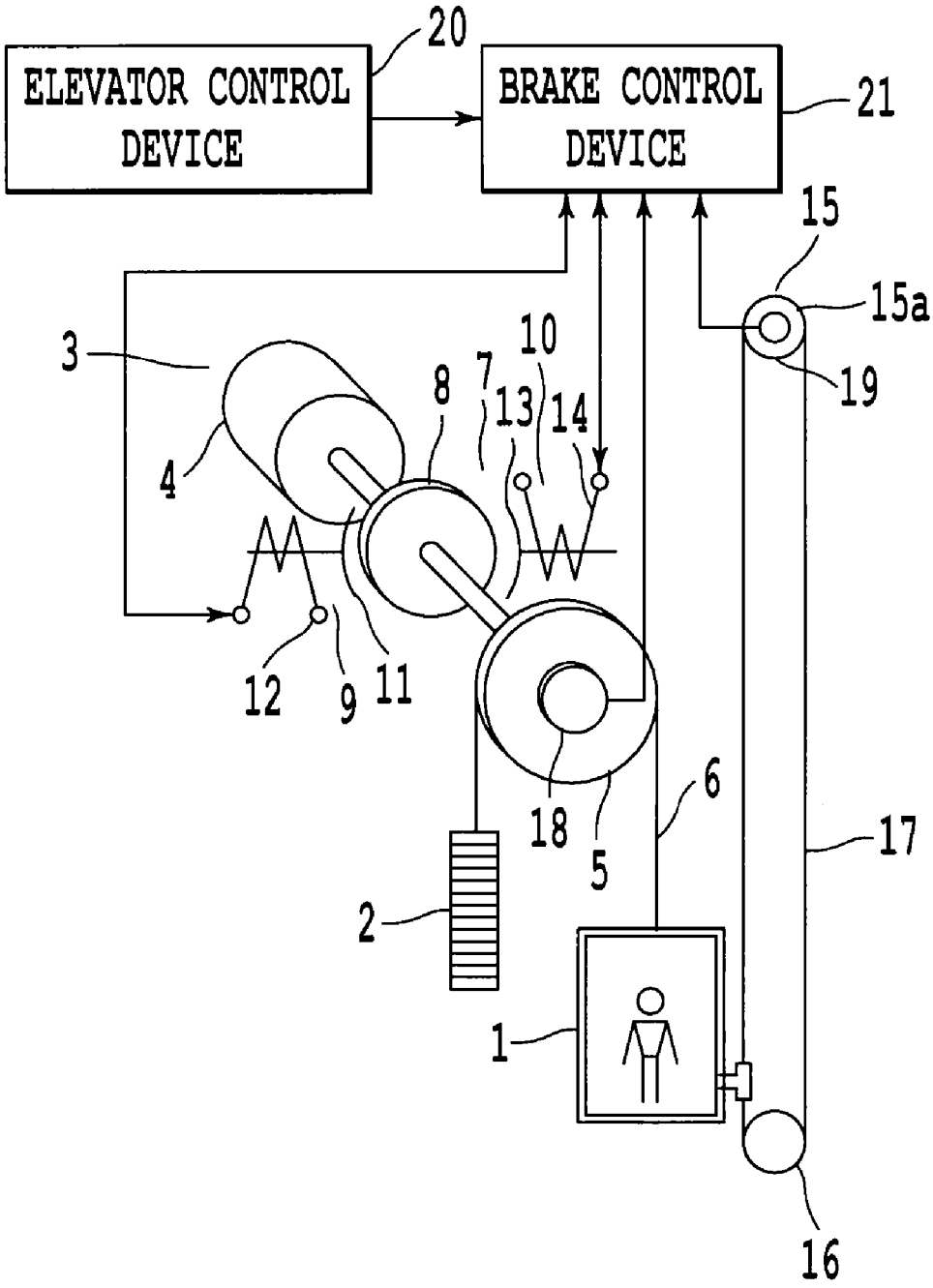
FIG. 1 is a diagram for illustrating an elevator apparatus according to a first embodiment of the present invention.

FIG. 1 is a diagram for illustrating an elevator apparatus according to a first embodiment of the present invention. In the figure, a car 1 and a balance weight 2 are moved in an up to down direction by the driving force of a hoist 3. The hoist 3 includes a motor 4 and a drive sheave 5 rotated by the motor 4. A main rope 6 is wound around the drive sheave 5. The car 1 and the balance weight 2 are suspended in a hoistway by the main rope 6. Therefore, the car 1 and the balance weight 2 are moved by the rotation of the drive sheave 5.

A brake device 7 that brakes the rotation of the drive sheave 5 is provided in the hoist 3. The brake device 7 includes a brake wheel (rotating member) 8 that is rotated integrally with the drive sheave 5 and a first brake unit 9 and a second brake unit 10 (plural brake units) that can separately brake the rotation of the brake wheel 8.

The first brake unit 9 includes a first brake lining 11 that can come into contact with and separate from the brake wheel 8, a first urging spring (not shown) that urges the first brake lining 11 in a direction in which the first brake lining 11 comes into contact with the brake wheel 8, and a first electromagnetic coil 12 that displaces the first brake lining 11 in a direction in which the first brake lining 11 separates from the brake wheel 8 against the urging force of the first urging spring.

The second brake unit 10 includes a second brake lining 13 that can come into contact with and separate from the brake wheel 8, a second urging spring (not shown) that urges the second brake lining 13 in a direction in which the second brake lining 13 comes into contact with the brake wheel 8, and a second electromagnetic coil 14 that displaces the second brake lining 13 in a direction in which the second brake lining 13 separates from the brake wheel 8 against the urging force of the second urging spring.

When energization to the first and second electromagnetic coils 12 and 14 is stopped, the first and second brake linings 11 and 13 are pressed against the brake wheel 8 by the urging forces of the first and second urging springs.

Consequently, braking force is applied to the brake wheel 8 and the drive sheave 5. When energization to the first and second electromagnetic coils 12 and 14 is performed, the first and second brake linings 11 and 13 are separated from the brake wheel 8 and the braking force applied to the brake wheel 8 and the drive sheave 5 is released.

When the driving of the hoist 3 is stopped, braking force is applied to the drive sheave 5 by the brake device 7. That is, when the driving of the hoist 3 is stopped, the rotation of the drive sheave 5 is prevented by the braking force of the brake device 7 such that the car 1 and the balance weight 2 do not move because of the deviation of a weight balance between the car 1 side and the balance weight 2 side. When the car 1 and the balance weight 2 are moved by the driving force of the hoist 3, the braking of the drive sheave 5 by the brake device 7 is released.

A speed governor 15 including a speed governor sheave 15*a* is provided in an upper part of the hoistway. A tension pulley 16 is provided in a lower part of the hoistway. A common speed governor rope 17 is wound around the speed governor sheave 15*a* and the tension pulley 16. One end and the other end of the speed governor rope 17 are connected to an emergency stop device (not shown) mounted on the car 1. Therefore, the speed governor sheave 15*a* and the tension pulley 16 are rotated according to the movement of the car 1.

When the rotating speed of the speed governor sheave 15*a* reaches predetermined set overspeed, the speed governor 15 grips the speed governor rope 17. The car 1 is displaced in the up to down direction with respect to the speed governor rope 17 according to the gripping of the speed governor rope 17 by the speed governor 15. Consequently, the emergency stop device is actuated and braking force is directly applied to the car 1.

A hoist encoder (movement detector) 18 that generates a signal corresponding to the rotation of the drive sheave 5 is provided in the hoist 3. A speed governor encoder (movement detector) 19 that generates a signal corresponding to the rotation of the speed governor sheave 15*a* is provided in the speed governor 15. In other words, both the hoist encoder 18 and the speed governor encoder 19 generate signals corresponding to the movement of the car 1.

In a landing, an abnormal time operation device (not shown) that can operated from the landing is provided. The abnormal time operation device is operated when abnormality of the elevator occurs. Information from the abnormal time operation device is sent to an elevator control device 20 that controls the operation of the elevator. When the abnormal time operation device is operated, the elevator control device 20 outputs a rescue operation command for performing rescue operation for the elevator. The output of the rescue operation command is continued when the operation of the abnormal time operation device is continued.

The signals from the hoist encoder 18 and the speed governor encoder 19 and the rescue operation command from the elevator control device 20 are sent to a brake control device 21 that controls the brake device 7. The brake control device 21 controls the brake device 7 based on each of the signals from the hoist encoder 18 and the speed governor encoder 19 and the rescue operation command from the elevator control device 20.

Figure 2:
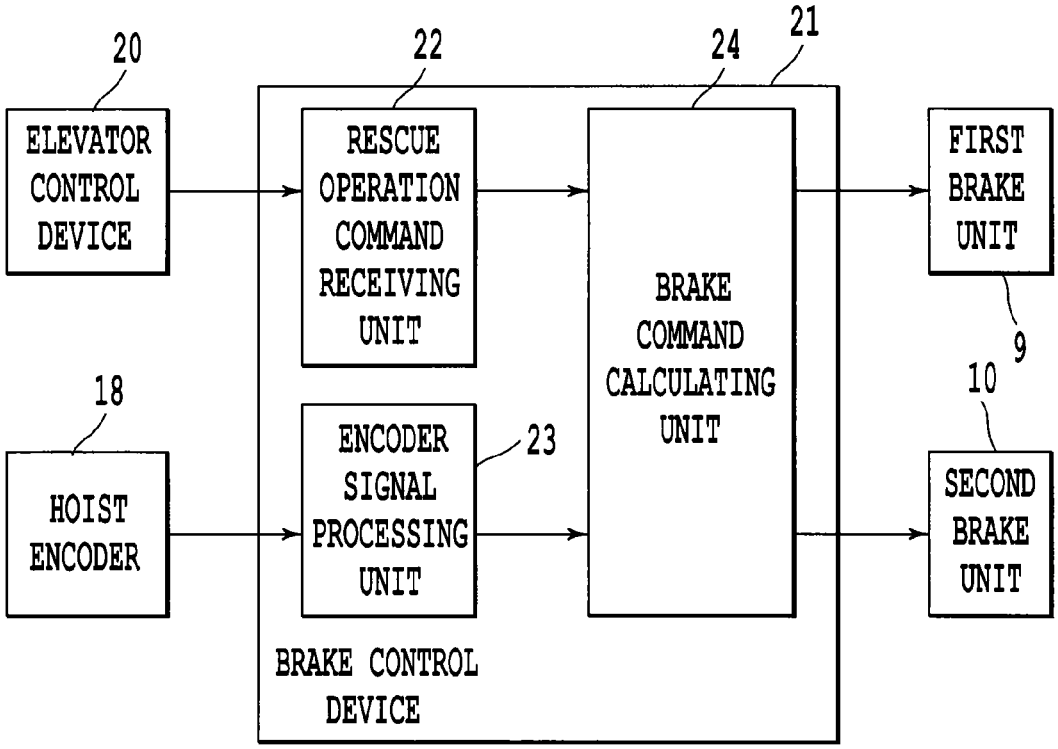
FIG. 2 is a block diagram for illustrating a brake control device of FIG. 1.

FIG. 2 is a block diagram for illustrating the brake control device 21 of FIG. 1. In the figure, the brake control device 21 includes a rescue operation command receiving unit 22, an encoder signal processing unit 23, and a brake command calculating unit 24.

The rescue operation command receiving unit 22 detects presence or absence of reception of the rescue operation command from the elevator control device 20. The rescue operation command receiving unit 22 continuously sends a command detection signal when the rescue operation command receiving unit 22 is detecting the reception of the rescue operation command. When the detection of the reception of the rescue operation command is stopped, the rescue operation command receiving unit 22 stops the output of the command detection signal.

The encoder signal processing unit 23 calculates the speed of the car 1 as detected speed based on the signal from the hoist encoder 18 or the speed governor encoder 19. In this example, the encoder signal processing unit 23 calculates the speed of the car 1 as detected speed based on only the signal from the hoist encoder 18. The calculation of detected speed is continuously performed when the encoder signal processing unit 23 is receiving the signal from the hoist encoder 18. The encoder signal processing unit 23 continuously sends the calculated detected speed to the brake command calculating unit 24. The calculation of detected speed may be performed based on only the signal from the speed governor encoder 19.

When the brake command calculating unit 24 is receiving the command detection signal from the rescue operation command receiving unit 22, the brake command calculating unit 24 generates a target pattern concerning the speed of the car 1 (temporal change in target value of speed of car 1) as a car speed target pattern. Values of parameters for generating the car speed target pattern are set in the brake command calculating unit 24 in advance.

The brake command calculating unit 24 compares the detected speed received from the encoder signal processing unit 23 and the generated car speed target pattern to thereby calculate brake control commands for separately controlling the first brake unit 9 and the second brake unit 10. The brake control commands are commands for reducing a difference between the detected speed and the car speed target pattern. The brake control commands are separately sent from the brake command calculating unit 24 to the first brake unit 9 and the second brake unit 10.

In the first brake unit 9 and the second brake unit 10, voltages to the first electromagnetic coil 12 and the second electromagnetic coil 14 are separately adjusted according to the brake control command and the driving force of the brake wheel 8 is separately controlled.

That is, the brake control device 21 outputs a brake control command (braking command) for increasing the braking force to the drive sheave 5 when the detected speed is larger than the car speed target pattern. The brake control device 21 outputs a brake control command (brake release command) for reducing the braking force to the drive sheave 5 when the detected speed is smaller than the car speed target pattern. Consequently, the brake control device 21 controls the braking force of the brake device 7 such that the detected speed follows the car speed target pattern.

Figure 3:
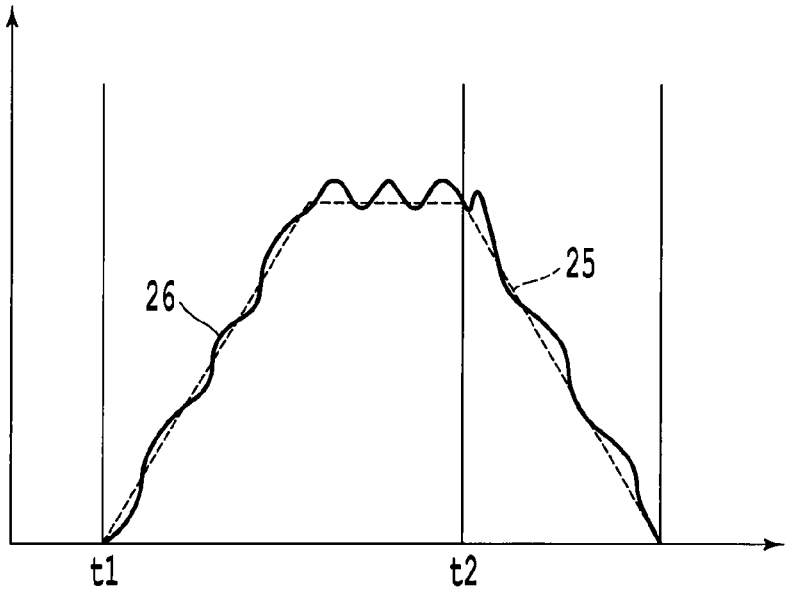
FIG. 3 is a graph for comparing a car speed target pattern generated by a brake command calculating unit of FIG. 2 and a temporal change in detected speed.

FIG. 3 is a graph for comparing the car speed target pattern generated by the brake command calculating unit 24 of FIG. 2 and a temporal change in the detected speed. In the figure, a car speed target pattern 25 is continuously generated from the time when the reception of the rescue operation command by the brake control device 21 is started (reception start time t1).

The car speed target pattern 25 after the reception start time t1 elapses is acceleration pattern for accelerating the car 1 until the speed of the car 1 reaches a predetermined value. The car speed target pattern 25 is a constant speed pattern for maintaining the car 1 at constant speed after the speed of the car 1 reaches the predetermined value. Further, when the reception of the rescue operation command by the brake control device 21 is stopped (pattern switching time t2), the car speed target pattern 25 is a deceleration pattern for decelerating and stopping the car 1. In other words, the car speed target pattern 25 is switched to the deceleration pattern when the operation of the abnormal time operation device is stopped.

Detected speed 26 temporally changes while changing plus and minus with respect to the car speed target pattern 25. A difference between the detected speed 26 from the time when the movement of the car 1 is started until the car 1 stops and the car speed target pattern 25 falls within a predetermined range.

The brake control device 21 includes a computer having an arithmetic processing unit (CPU), storing units (ROM, RAM, etc.), and a signal input and output unit. Functions of the rescue operation command receiving unit 22, the encoder signal processing unit 23, and the brake command calculating unit 24 are realized by the computer of the brake control device 21. That is, a program for realizing the functions of the rescue operation command receiving unit 22, the encoder signal processing unit 23, and the brake command calculating unit 24 is stored in the storing unit of the computer. Values of parameters for calculating a car speed target pattern are also stored in the storing unit of the computer. The arithmetic processing unit executes arithmetic processing concerning the function of the brake control device 21 based on the program stored in the storing unit.

Next, operation is described. During normal operation, the braking force applied to the drive sheave 5 is released according to the control by the brake control device 21. The car 1 and the balance weight 2 are moved by the driving force of the hoist 3.

When some abnormality occurs in the elevator, the driving of the hoist 3 is stopped according to the control by the elevator control device 20. Braking operation for the brake device 7 is performed according to the control by the brake control device 21. Consequently, the braking force is applied to the drive sheave 5. The car 1 and the balance weight 2 are stopped and held.

For example, when the car 1 is stopped between upper and lower floors, the abnormal time operation device is operated in the landing, whereby the car 1 and the balance weight 2 are moved. That is, rescue operation for moving the car 1 and the balance weight 2 according to the deviation of a weight balance between the car 1 side and the balance weight 2 side while adjusting the braking force applied to the drive sheave 5 is performed according to the operation of the abnormal time operation device. The adjustment of the braking force during the rescue operation is performed according to the control of the brake device 7 by the brake control device 21. The rescue operation is performed while the driving of the hoist 3 is stopped. In this way, the car 1 is moved to a closest floor.

Figure 4:
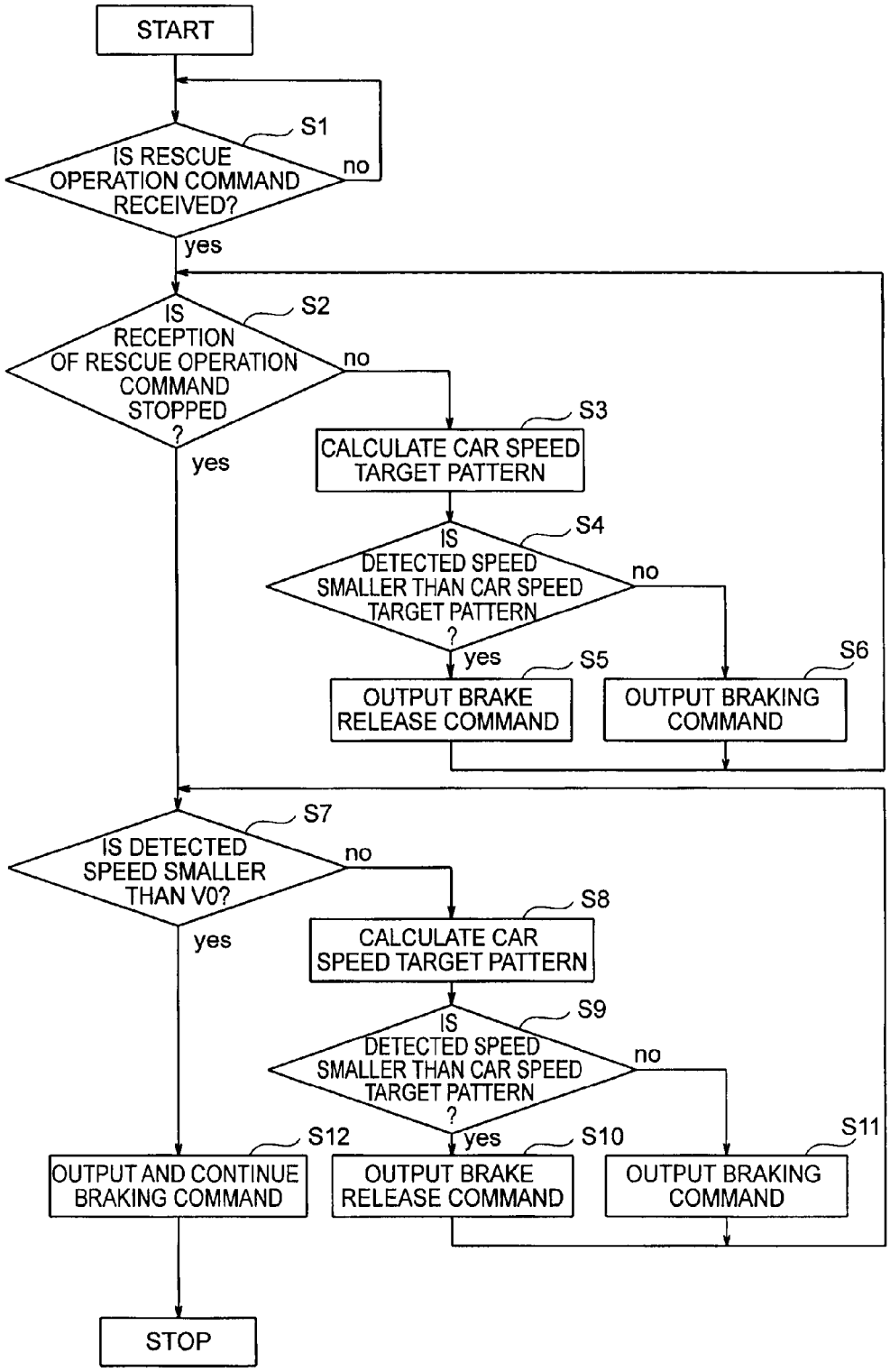
FIG. 4 is a flowchart for illustrating processing operation of the brake control device of FIG. 2.

FIG. 4 is a flowchart for illustrating processing operation of the brake control device 21 of FIG. 2. As illustrated in the figure, the brake control device 21 always determines whether or not a rescue operation command output from the elevator control device 20 according to the operation of the abnormal time operation device is received (S1). When the rescue operation command is not received, the brake control device 21 repeatedly determines presence or absence of reception of the rescue operation command.

When the rescue operation command is received, the brake control device 21 determines whether or not the reception of the rescue operation command is stopped (S2).

When the reception of the rescue operation command is stopped, i.e., when the reception of the rescue operation command continues, the brake control device 21 calculates a car speed target pattern (S3). At this point, the car speed target pattern is calculated according to time from reception start time t1 of the rescue operation command. That is, before predetermined period of time elapses from the reception start time t1, an acceleration pattern for accelerating the car 1 is calculated as the car speed target pattern. After the predetermined period of time elapses and the speed of the car 1 reaches a predetermined value, a constant speed pattern for maintaining the car 1 at constant speed is calculated as the car speed target pattern.

After that, the brake control device 21 determines whether or not detected speed calculated based on a signal from the hoist encoder 18 is smaller than the car speed target pattern (S4). As a result, when the detected speed is smaller than the car speed target pattern, the brake control device 21 outputs a brake release command for reducing braking force to the brake device 7 as a brake control command (S5). When the detected speed is equal to or larger than the car speed target pattern, the brake control device 21 outputs a braking command for increasing the braking force to the brake device 7 as the brake control command (S6). After that, the brake control device 21 determines again whether or not the reception of the rescue operation command is stopped (S2).

When the reception of the rescue operation command by the brake control device 21 is stopped according to the stop of the operation of the abnormal time operation device, the brake control device 21 determines whether or not the detected speed is smaller than predetermined stop determination speed V0 (V0≧0) (S7). The stop determination speed V0 is speed close to the stop of the car 1 for preventing the impact on the car 1 from increasing even if full braking force of the brake device 7 is applied to the drive sheave 5.

When the detected speed is equal to or larger than the stop determination speed V0, the brake control device 21 calculates a car speed target pattern (S8). The car speed target pattern at this point is a deceleration pattern for decelerating the car 1 according to time from pattern switching time t2.

After that, the brake control device 21 determines whether or not the detected speed is smaller than the car speed target pattern (S9). As a result, when the detected speed is smaller than the car speed target pattern, the brake control device 21 outputs a brake release command to the brake device 7 as a brake control command (S10). When the detected speed is equal to or larger than the car speed target pattern, the brake control device 21 outputs a braking command to the brake device 7 as the brake control command (S11). After that, the brake control device 21 determines again whether or not the detected speed is smaller than the stop determination speed V0 (S7).

When the detected speed decreases to be smaller than the stop determination speed V0, the brake control device 21 outputs the braking command to the brake device 7 and continues the output of the brake control command (S12). Consequently, the movement of the car 1 is stopped.

In such an elevator apparatus, the braking force of the brake device 7 is controlled by the brake control device 21 based on the signal from the hoist encoder 18 such that the speed of the car 1 follows the car speed target pattern in a state in which the driving of the hoist 3 is stopped. Therefore, by setting the car speed target pattern to make a change in the speed of the car 1 gentle, it is possible to prevent the car 1 from repeating quick accelerate and quick deceleration. Consequently, it is possible to stably move the car 1 at abnormal time of the elevator. Therefore, it is possible to reduce load on passengers in the car 1, the main rope 6, and the like.

The brake control device 21 increases the braking force of the brake device 7 when the speed of the car 1 is larger than the car speed target pattern and reduces the braking force of the brake device 7 when the speed of the car 1 is smaller than the car speed target pattern. Therefore, it is possible to surely control the speed of the car 1 to follow the car speed target pattern.

Second Embodiment

Figure 5:
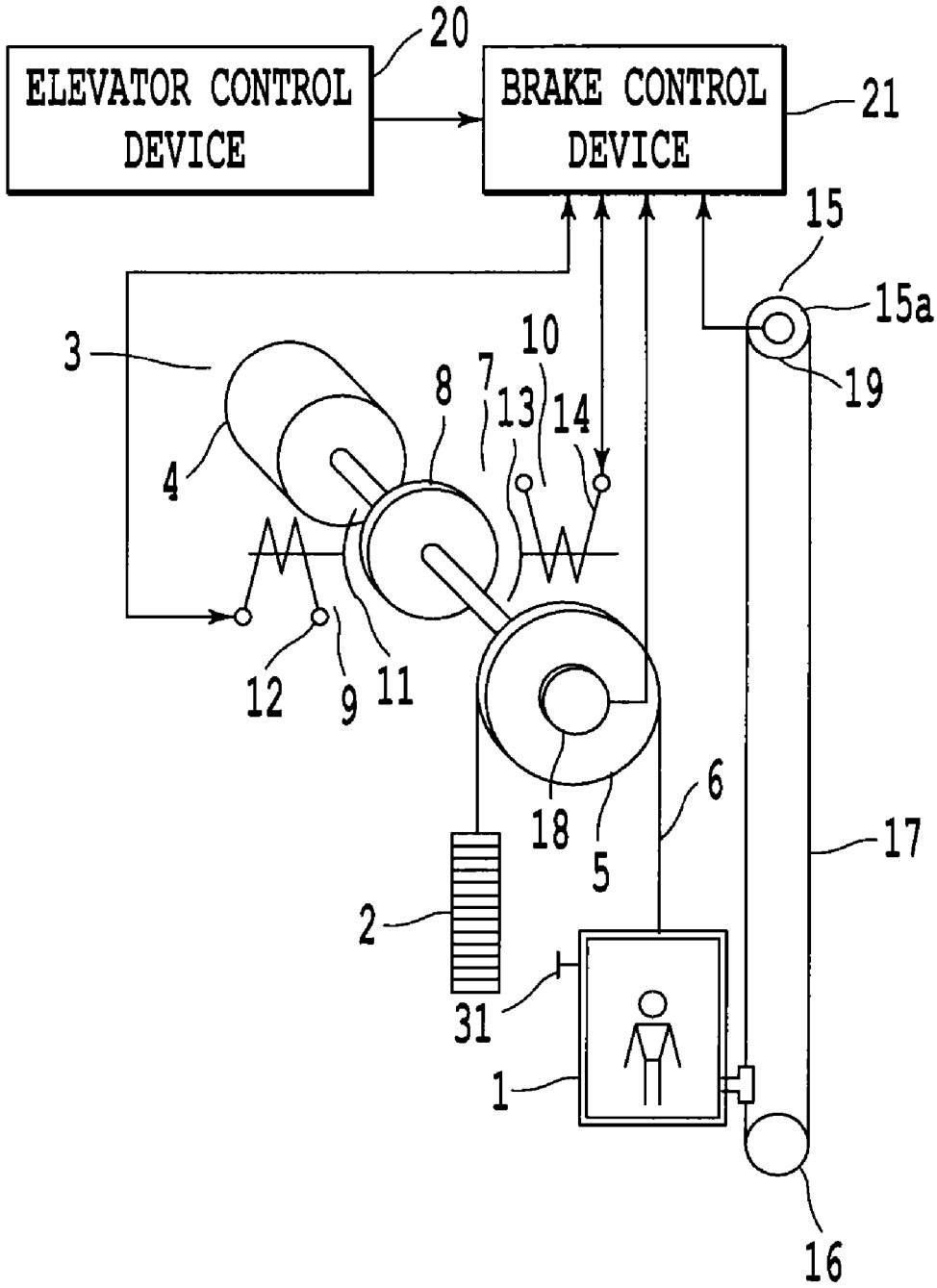
FIG. 5 is a diagram for illustrating an elevator apparatus according to a second embodiment of the present invention.
Figure 6:
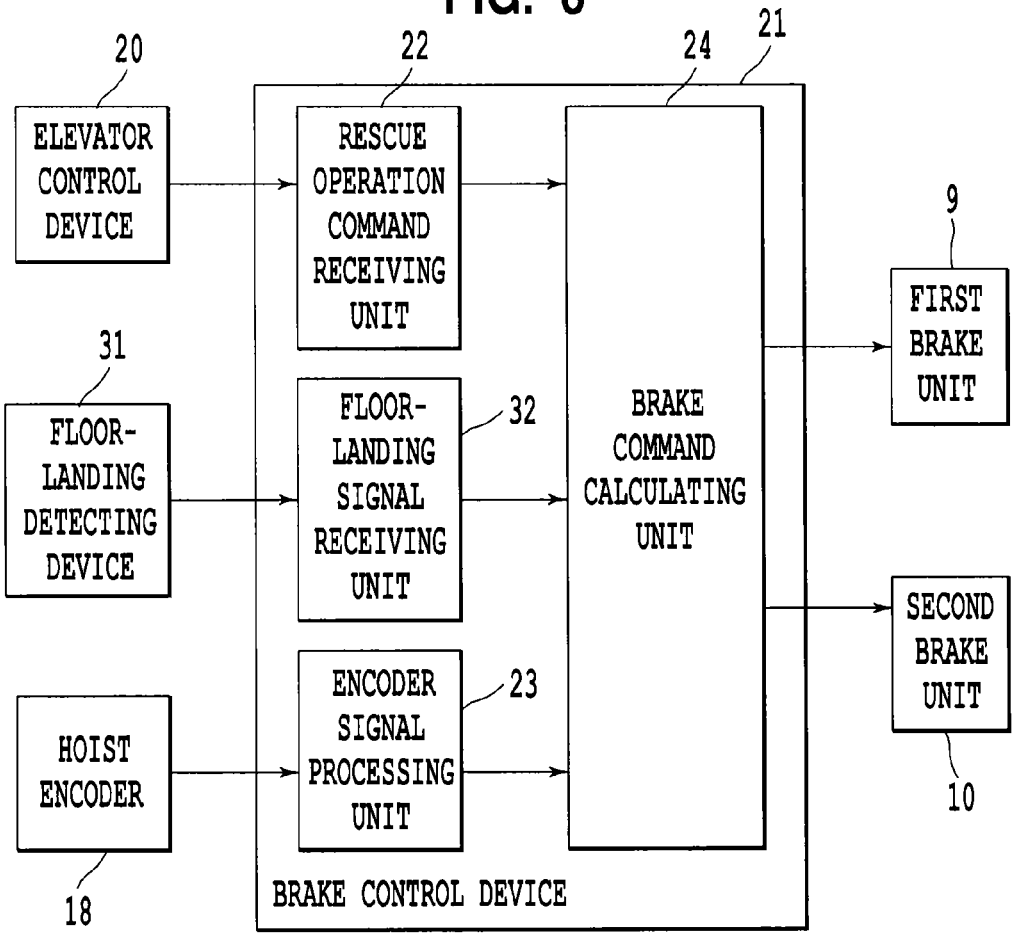
FIG. 6 is a block diagram for illustrating a brake control device of FIG. 5.

FIG. 5 is a diagram for illustrating an elevator apparatus according to a second embodiment of the present invention. FIG. 6 is a block diagram for illustrating the brake control device 21 of FIG. 5. In the figure, a car entrance (not shown)

opened and closed by a car door is provided in the car 1. In floors, landing entrances (not shown) opened and closed by landing doors are provided. Engaging devices (not shown) are provided in the car door and the landing doors. The car door and the landing doors are engaged with each other by the engaging devices only when the car 1 is stopped in a predetermined allowed floor-landing range set for the respective floors. The car entrance and the landing entrances are simultaneously opened and closed when the car door and the landing doors are moved in the horizontal direction while engaging with each other.

In the car 1, a floor-landing detecting device (car floor-landing range detecting means) 31 that detects whether or not the position of the car 1 falls within the allowed floor-landing range is provided. The floor-landing detecting device 31 detects presence or absence of plural detection objects fixed in the hoistway. The floor-landing detecting device 31 outputs a floor-landing signal to the brake control device 21 when the detection object is detected.

The brake control device 21 includes the rescue operation command receiving unit 22, the encoder signal processing unit 23, the brake command calculating unit 24, and a floor-landing signal receiving unit 32. Configurations of the rescue operation command receiving unit 22 and the encoder signal processing unit 23 are the same as those in the first embodiment.

The floor-landing signal receiving unit 32 detects, based on the reception of the floor-landing signal from the floor-landing detecting device 31, that the position of the car falls within the allowed floor-landing range. When the floor-landing signal receiving unit 32 detects that the position of the car 1 falls within the allowed floor-landing range, the floor-landing signal receiving unit 32 outputs a floor-landing confirmation signal to the brake command calculating unit 24.

The brake command calculating unit 24 generates a car speed target pattern when the brake command calculating unit 24 is receiving the command detection signal from the rescue operation command receiving unit 22. The brake command calculating unit 24 generates a deceleration pattern for decelerating the car 1 as a car speed target pattern when the brake command calculating unit 24 is receiving the floor-landing confirmation signal from the floor-landing signal receiving unit 32. Further, the brake command calculating unit 24 compares the detected speed received from the encoder signal processing unit 23 and the generated car speed target pattern to thereby calculate brake control commands for separately controlling the first brake unit 9 and the second brake unit 10.

Figure 7:
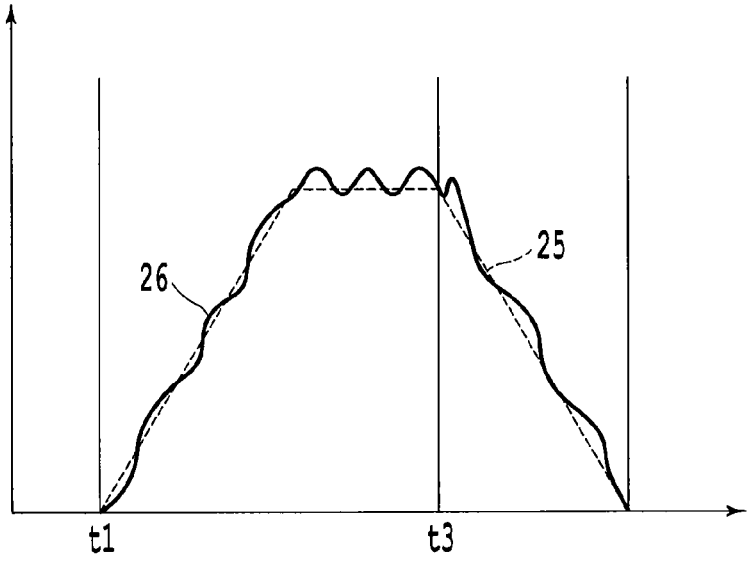
FIG. 7 is a graph for comparing a car speed target pattern generated by a brake command calculating unit of FIG. 6 and a temporal change in detected speed.

FIG. 7 is a graph for comparing the car speed target pattern generated by the brake command calculating unit 24 of FIG. 6 and a temporal change in the detected speed. In the figure, a car speed target pattern 25 is continuously generated from the time when the reception of the rescue operation command by the brake control device 21 is started (reception start time t1). The car speed target pattern 25 after the reception start time t1 elapses is acceleration pattern for accelerating the car 1 until the speed of the car 1 reaches a predetermined value. The car speed target pattern 25 is a constant speed pattern for maintaining the car 1 at constant speed after the speed of the car 1 reaches the predetermined value.

Further, when the stop of the reception of the rescue operation command by the brake control device 21 or the start of the reception of the floor-landing signal by the brake control device 21 occurs (pattern switching time t3), the car speed target pattern 25 is switched to a deceleration pattern for decelerating and stopping the car 1. That is, when the operation of the abnormal time operation device is stopped or the floor-landing detecting device 31 detects the entrance of the car 1 into the allowed floor-landing range, the car speed target pattern 25 is switched to the deceleration pattern.

Detected speed 26 temporally changes while changing plus and minus with respect to the car speed target pattern 25. A difference between the detected speed 26 from the time when the movement of the car 1 is started until the car 1 stops and the car speed target pattern 25 falls within a predetermined range. Other configurations are the same as those in the first embodiment.

Next, operation is described. The operation of the elevator during the normal operation is the same as that in the first embodiment. Therefore, processing operation of the brake control device 21 during the rescue operation is described.

Figure 8:
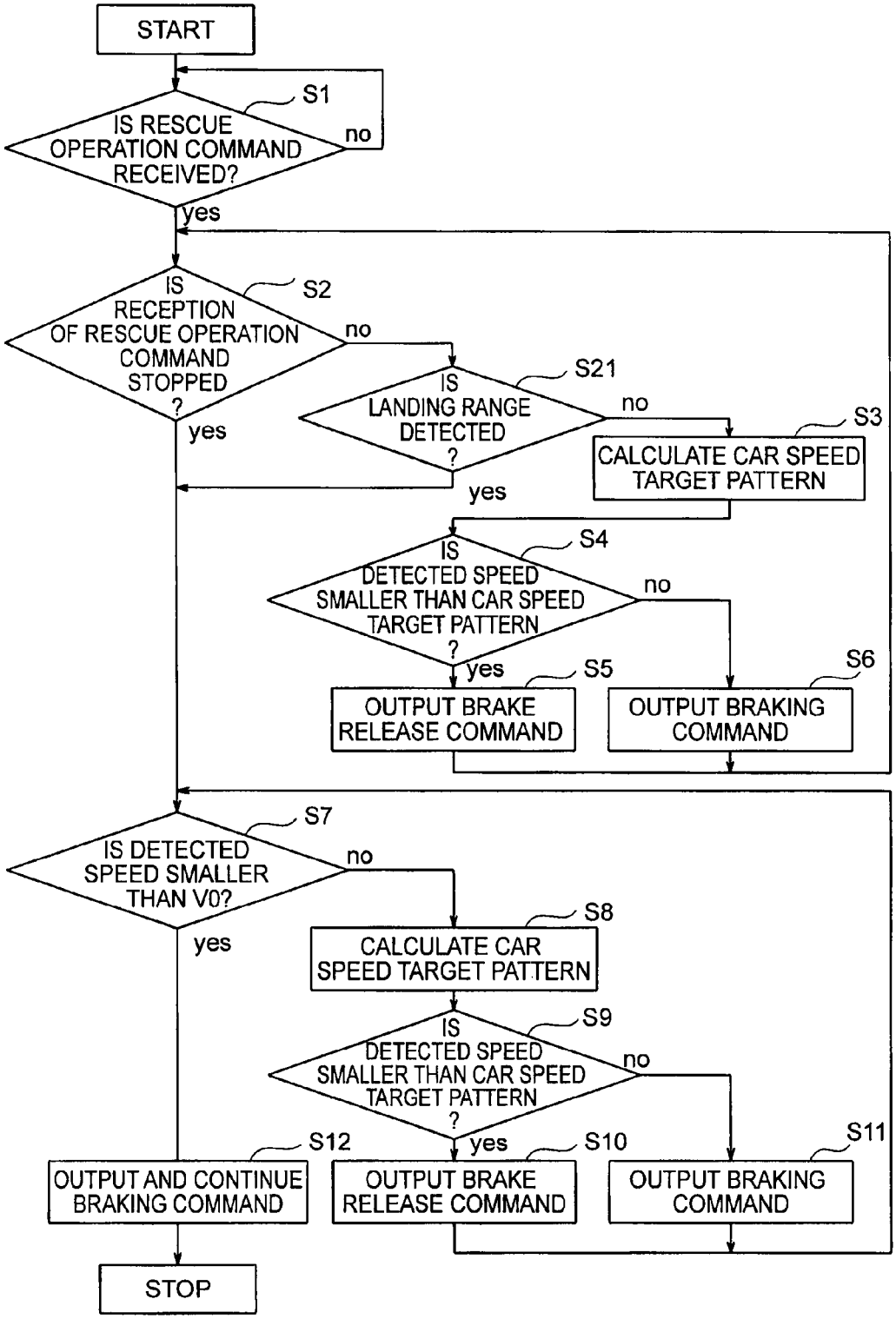
FIG. 8 is a flowchart for describing processing operation of the brake control device of FIG. 6.

FIG. 8 is a flowchart for illustrating processing operation of the brake control device 21 of FIG. 6. As illustrated in the figure, the brake control device 21 always determines whether or not a rescue operation command output from the elevator control device 20 is received (S1). When the rescue operation command is not received, the brake control device 21 repeatedly determines presence or absence of reception of the rescue operation command.

When the rescue operation command is received, the brake control device 21 determines whether or not the reception of the rescue operation command is stopped (S2).

When the reception of the rescue operation command continues, the brake control device 21 determines whether or not the floor-landing signal from the floor-landing detecting device 31 is received, i.e., whether or not the position of the car 1 falls within the allowed floor-landing range (S21).

When the floor-landing signal is not received, the brake control device 21 calculates a car speed target pattern same as that in the first embodiment (S3). Subsequent processing operation is the same as that in the first embodiment (S4 to S6).

On the other hand, when the reception of the rescue operation command is stopped or when the reception of the floor-landing signal from the floor-landing detecting device 31 is started, as in the first embodiment, the brake control device 21 determines whether or not the detected speed is smaller than the stop determination speed V0 (S7). Subsequent processing operation is the same as that in the first embodiment (S8 to S12).

In such an elevator apparatus, when the floor-landing detecting device 31 detects entrance of the car 1 into the allowed floor-landing range, the brake control device 21 generates a deceleration pattern for decelerating the car 1 as a car speed target pattern. Therefore, the car 1 can be stopped within the allowed floor-landing range. That is, a distance from the time when the car 1 starts deceleration until the car 1 is stopped according to the deceleration pattern is usually shorter than the allowed floor-landing range. Therefore, it is possible to stop the car 1 within the allowed floor-landing range by decelerating the car 1 when the car 1 starts entrance into the allowed floor-landing range. Consequently, when the car 1 stops, it is possible to simultaneously perform opening and closing of the car entrance and the landing entrances. It is also possible to prevent the car 1 from moving past the landing or prevent the car 1 from colliding against the upper part or the lower part of the hoistway.

In the example described above, the detection concerning whether or not the position of the car 1 falls within the allowed floor-landing range is performed according to presence or absence of detection of the detection object by the floor-landing detecting device 31. However, the present invention is not limited to this. For example, it may be detected whether or not the position of the car 1 falls within the allowed floor-landing range by calculating the position of the car 1 based on the signal from the speed governor encoder 19 and comparing the calculated position of the car 1 and information concerning the allowed floor-landing range stored in the brake control device 21 in advance.

Third Embodiment

In the example described above, the brake control device 21 generates, based on the parameters set in advance, the predetermined deceleration pattern as the car speed target pattern. However, a deceleration pattern for decelerating the car 1 such that a floor-landing position in the landing located within the allowed floor-landing range and a stop position of the car 1 coincide with each other may be generated as the car speed target pattern.

That is, information concerning a floor-landing position in the landing indicating the position of a landing floor is set in the brake control device 21 in advance. The floor-landing position in the landing is located within the allowed floor-landing range. The brake control device 21 calculates, based on the signal from the hoist encoder 18 and the information concerning the floor-landing position in the landing, a distance from the present position of the car 1 to the floor-landing position in the landing (floor-landing position remaining distance). The brake control device 21 calculates, based on the signal from the hoist encoder 18, a distance (reference stop distance) until the car 1 that moves from the present position of the car 1 according to a predetermined deceleration pattern (deceleration pattern generated based on parameters set in advance) stops. Further, the brake control device 21 generates, based on the detected speed calculated according to the signal from the hoist encoder 18, the floor-landing position remaining distance, and the reference stop distance, a deceleration pattern, with which a stop position of the car 1 and the floor-landing position in the landing coincide with each other, as a car speed target pattern. Other configurations are the same as those in the second embodiment.

Figure 9:
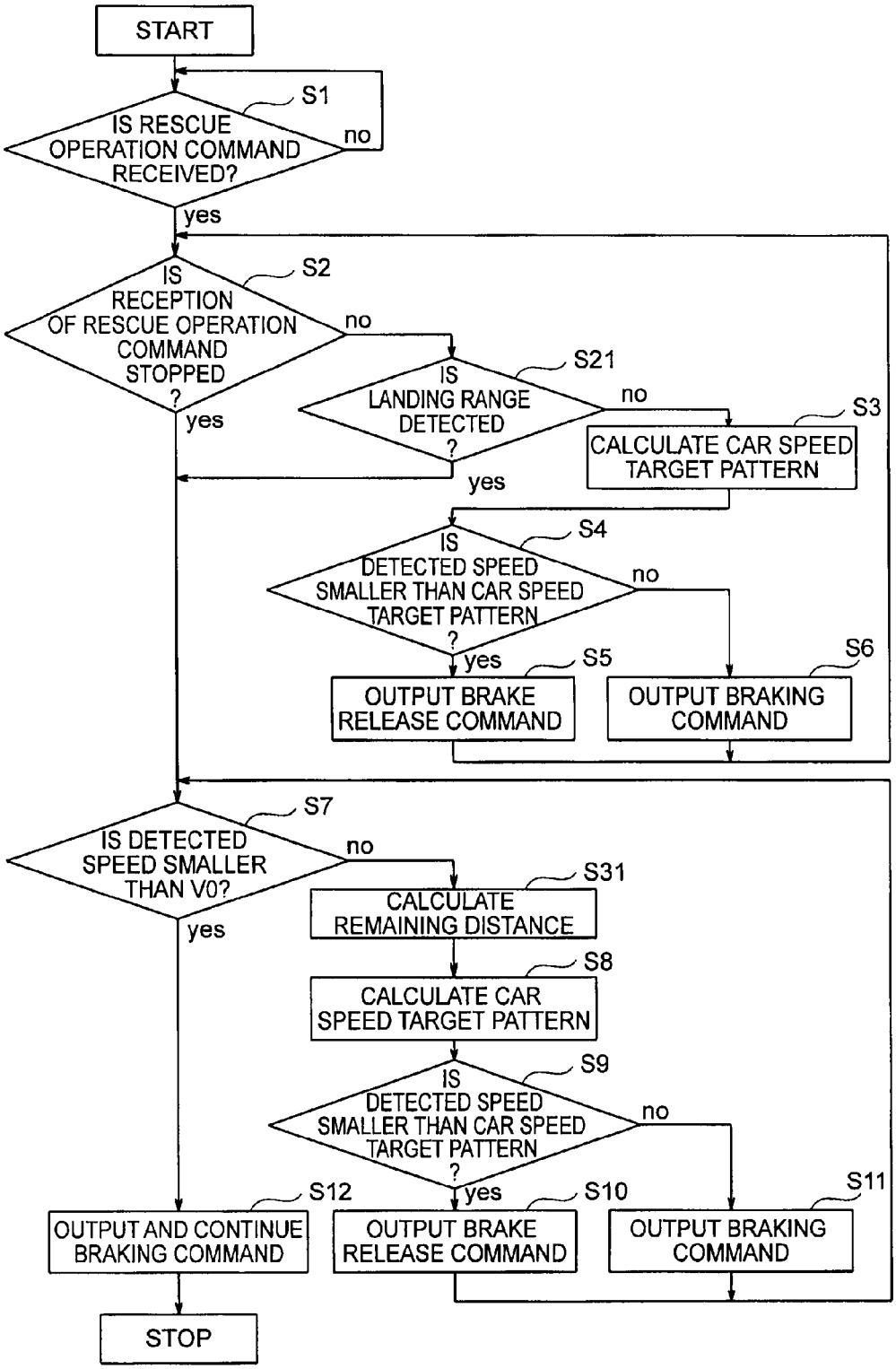
FIG. 9 is a flowchart for illustrating processing operation of a brake control device in an elevator apparatus according to a third embodiment of the present invention.

Next, processing operation of the brake control device 21 is described. FIG. 9 is a flowchart for illustrating processing operation of a brake control device in an elevator apparatus according to the third embodiment of the present invention. As illustrated in the figure, processing operation of the brake control device 21 is the same as that in the second embodiment up to the step of determining whether or not the detected speed is smaller than the stop determination speed V0 (S1 to S6).

When it is determined by the determination by the brake control device 21 that the detected speed is equal to or larger than the stop determination speed V0, the brake control device 21 calculates a floor-landing position remaining distance from the position of the car 1 to the floor-landing position in the landing (S31). After that, the brake control device 21 generates a deceleration pattern, with which a distance until the car 1 stops is the floor-landing position remaining distance, as a car speed target pattern (S8). Subsequent processing operation is the same as that in the second embodiment (S9 to S12).

In such an elevator apparatus, a deceleration pattern for decelerating the car 1 such that the stop position of the car 1 coincides with the floor-landing position in the landing is generated by the brake control device 21. Therefore, it is possible to more surely land the car 1 on the floors.

In the embodiments described above, the detected speed calculated by the encoder signal processing unit 23 and the car speed target pattern calculated by the brake command calculating unit 24 are compared, whereby the braking force of the brake device 7 is controlled. However, the encoder signal processing unit 23 may calculate the acceleration of the car 1 as detected acceleration and the brake command calculating unit 24 may calculate a target pattern concerning the acceleration of the car 1 as a car acceleration target pattern. The braking force of the brake device 7 may be controlled by comparing the detected acceleration and the car acceleration target pattern.

In this case, the detected acceleration is calculated based on the signal from the hoist encoder 18 or the speed governor encoder 19. The car acceleration target pattern is calculated based on a temporal change in speed in the car speed target pattern. Further, the control of the brake device 7 is performed such that the detected acceleration follows the car acceleration target pattern. In this way, it is also possible to stably move the car 1 at the abnormal time of the elevator.

The braking force of the brake device 7 may be controlled based on a comparison result of the detected speed and the car speed target pattern and a comparison result of the detected acceleration and the car acceleration target pattern.

In the embodiments described above, the abnormal time operation device is provided in the landing. However, the abnormal time operation device may be provided as a remote operation device in a remote location such as a disaster prevention center or the like. That is, the brake control device 21 may perform the start and the stop of the control of the brake device 7 according to presence or absence of the operation of the remote operation device provided in the remote location. In this way, it is possible to operate the movement of the car 1 from a distance and more quickly rescue passengers in the car 1.

In the embodiments described above, the car 1 of one elevator apparatus is moved according to the operation of the abnormal time operation device. However, cars of plural elevators may be simultaneously moved according to the operation of a common abnormal time operation device. In this way, it is possible to collectively move plural cars.

The brake device 7 and the brake control device 21 may receive power supply from an electrical storage device (battery). Consequently, it is possible to more stably move the car 1 even during service interruption.

The invention claimed is:

1. An elevator apparatus, comprising:

a car and a balance weight suspended by a main rope;

a hoist that generates driving force for moving the car and the balance weight;

a movement detector that generates a signal corresponding to movement of the car;

a brake device that brakes the movement of the car in a state in which driving of the hoist is stopped, the braking device operating by urging one part against another part; and a brake control device that generates a target pattern concerning at least one of speed and acceleration of the car in a state in which the driving of the hoist is stopped and that controls braking force of the brake device based on the signal from the movement detector such that the movement of the car follows the target pattern.

2. An elevator apparatus according to claim 1, wherein the brake control apparatus increases the braking force of the brake device when the signal from the movement detector is larger than the target pattern and reduces the braking force of the brake device when the signal from the movement detector is smaller than the target pattern.

3. An elevator apparatus according to claim 1, further comprising car floor-landing range detecting means for detecting whether or not a position of the car falls within a predetermined floor-landing range, wherein, when the car floor-landing range detecting means detects entrance of the car into the allowed floor-landing range, the brake control device generates the target pattern for decelerating the car.

4. An elevator apparatus according to claim 3, wherein the brake control device generates, based on information concerning a floor-landing position in a landing located within the allowed floor-landing range and the signal from the movement detector, the target pattern for decelerating the car such that a stop position of the car coincides with the floor-landing position in the landing.

5. An elevator apparatus according to claim 1, wherein the brake control device performs start and stop of control of the brake device according to presence or absence of operation of a remote operation device.

6. An elevator apparatus according to claim 1, wherein the brake device and the brake control device receive power supply from an electrical storage device.

* * * * *